US007198763B2

(12) United States Patent
Holm-Christensen

(10) Patent No.: US 7,198,763 B2
(45) Date of Patent: Apr. 3, 2007

(54) METHOD FOR DISTRIBUTION OF GAS, GAS DISTRIBUTING DEVICE AND SILENCER-CATALYST SYSTEM

(75) Inventor: Olav Holm-Christensen, Copenhagen K (DK)

(73) Assignee: Haldor Topsoe A/S (DK)

( * ) Notice: Subject to any disclaimer, the term of this patent is extended or adjusted under 35 U.S.C. 154(b) by 715 days.

(21) Appl. No.: 10/193,155

(22) Filed: Jul. 12, 2002

(65) Prior Publication Data

US 2003/0041896 A1 Mar. 6, 2003

(30) Foreign Application Priority Data

Sep. 1, 2001 (DK) ..... 2001 01290

(51) Int. Cl.

| | |
|---|---|
| ***F01N 3/08*** | (2006.01) |
| ***F02C 1/00*** | (2006.01) |
| ***F02M 29/06*** | (2006.01) |
| ***B01D 47/00*** | (2006.01) |

(52) U.S. Cl. ..... 422/176; 60/39.65; 123/306; 55/220

(58) Field of Classification Search ..... 422/177, 422/180, 171, 176, 195, 224
See application file for complete search history.

(56) References Cited

U.S. PATENT DOCUMENTS

| | | | | |
|---|---|---|---|---|
| 3,880,597 A | | 4/1975 | Goldschmidt et al. | |
| 3,919,840 A | * | 11/1975 | Markowski | 60/737 |
| 4,054,418 A | * | 10/1977 | Miller et al. | 422/171 |
| 4,182,120 A | | 1/1980 | Niebylski | |
| 4,529,356 A | | 7/1985 | Ciccarone | |
| 5,194,076 A | * | 3/1993 | Myers et al. | 96/370 |
| 5,685,143 A | | 11/1997 | Aitta et al. | |
| 5,723,041 A | | 3/1998 | Devanathan et al. | |
| 6,158,412 A | * | 12/2000 | Kim | 123/306 |

FOREIGN PATENT DOCUMENTS

| | | |
|---|---|---|
| DE | 4015013 A1 | 11/1994 |
| EP | 0 555746 A1 | 8/1993 |
| EP | 0 894523 A1 | 2/1999 |
| EP | 1022048 A1 | 7/2000 |
| FR | 2 226 865 | 11/1974 |
| FR | 249 2455 | 4/1982 |
| JP | 08-312339 | 11/1996 |
| RU | 2113600 C1 | 6/1998 |
| SU | 1719671 A1 | 3/1992 |

* cited by examiner

*Primary Examiner*—Alexa Neckel
*Assistant Examiner*—Kaity Handal
(74) *Attorney, Agent, or Firm*—Dickstein Shapiro LLP

(57) ABSTRACT

A method and a device for the distribution of gas. The method includes the steps of transferring the gas into a swirl chamber through an inlet section positioned tangentially to the swirl chamber, swirling the gas in the swirl chamber by passage through a number of equally displaced bent vanes, the surface of the upstream part of the vanes lying in a plane perpendicular to the swirl chamber's axis, the downstream part of the vanes being parallel to the swirl chamber's axis, and the vanes extending radially outward, and passing the gas through an outlet section positioned downstream the swirl chamber.

7 Claims, 2 Drawing Sheets

METHOD FOR DISTRIBUTION OF GAS, GAS DISTRIBUTING DEVICE AND SILENCER-CATALYST SYSTEM

The invention concerns a process and device for the distribution of a gas using a gas distributing device. More particularly, the invention relates to the distribution of a fast-flowing gas through a distributing device resulting low pressure drop and a good gas distribution.

Gas distribution is important in many applications and a particularly important field is the treatment of exhaust gases from combustion systems.

Within the European truck industry, it is a criterion that the exhaust gases from internal combustion engines enter the applied silencer-catalyst system tangentially. This is important since the lack of space demands that the required systems are as small as possible. However, this leads to constraints on the gas distribution, and this affects the pressure drop and the flow distribution of the exhaust gas stream.

A homogeneous flow distribution is easily attainable provided the availability of pressure drop. However, in the case of the catalyst-silencer unit mentioned above, both a homogeneous flow profile and a reduced pressure loss is required.

Various distribution devices have been described in the patent literature. EP patent application No. 1022048 discloses a device for ensuring even distribution and homogeneity during mixing of a reducing agent with exhaust gases in the exhaust pipe of an internal combustion engine. This is achieved by means of fixed vanes generating swirling gas motion within the exhaust pipe, and this motion counteracts the force of gravity on the flow profile.

U.S. Pat. No. 5,723,041 describes a process for promoting annularly uniform flow in a reaction space of a mixed phase reactor. Uniform flow is achieved by transferring the feed fluid into a device consisting of an external housing with stationary vanes and an internal recycle pump with rotating impeller vanes.

Silencers comprising different types of vanes for sound reduction are also mentioned in, for instance, RU patent No. 2113600 and SU patent application No. 1719671. The use of conical swirl generators for creating a rotational movement of the gas has been stated as having a sound dampening effect.

Various other processes and devices utilizing equipment without wings, vanes, etc are also described in the literature, see for instance WO patent application No. 9701387. This document describes the reaction of a reducing agent with exhaust fumes in consecutive longitudinal channels and with flow in opposite directions. EP patent application No. 0894523 describes a static mixer with mixing elements which vortex the fluid flowing through the mixer. DE patent application No. 4203807 also describes yet another type of mixing device.

Conventional processes such as those mentioned above do not include any design that exhibits both a homogeneous flow profile and limited pressure changes.

SUMMARY OF THE INVENTION

It is therefore an objective of the invention to provide a process and a device for gas distribution.

It is a further objective of the invention to provide a method and device for gas distribution, which ensures a minimal pressure drop across the device.

Yet another objective of the invention is to provide a method and a device for gas distribution ensuring homogeneous flow of the gas.

The above objectives are achieved by the invention, which provides a method for the distribution of gas comprising transferring the gas into a swirl chamber through an inlet section positioned tangentially to the swirl chamber, stopping the swirling motion of the gas in the swirl chamber by passage through a number of equally displaced bent vanes, the surface of the upstream part of the vanes lying in a plane perpendicular to the swirl chamber's axis, the downstream part of the vanes being parallel to the swirl chamber's axis, and the vanes extending radially outwards, and passing the gas through an outlet section positioned downstream the swirl chamber.

The invention further provides a gas distributing device being useful in the application of the above gas distributing method.

The gas distributing device according to the invention comprises a swirl chamber with an inlet and an outlet section, the inlet section positioned tangentially to the swirl chamber, and the outlet section positioned downstream the swirl chamber, the swirl chamber containing an element consisting of a number of equally displaced bent vanes, the surface of the upstream part of the vanes lying in a plane perpendicular to the swirl chamber's axis, the downstream part of the vanes being parallel to the swirl chamber's axis, the vanes extending radially outwards.

The gas distributing device can be used in connection with internal combustion engines for distributing exhaust gas into silencer-catalyst systems. It can also be used for gas distribution in other types of systems, where limited pressure changes are a requirement for the effective functioning of the system.

DETAILED DESCRIPTION OF THE INVENTION

With the method and device of the invention, the direction of a gas flowing at a high speed of, for instance, 100 m/s, can be turned 90 degrees. Simultaneously, it is possible to equally distribute the gas over an outlet surface area 10–20 times larger than the inlet surface area. The device of the invention is useful for controlling pressure loss and a minimal drop in pressure is observed. The reduced pressure drop observed is attributed to the establishment of a homogeneous gas flow after passage through the gas distribution device.

In the case where the gas distributing device is to be used in a silencer, the dimension in the device's axial direction is restricted to a maximum of 2.5 times the inlet pipe's diameter. This restriction is purely due to the minimal space available in the silencer and a gas distributing device that is too large will not fit into the silencer. When the device is to be placed in a silencer, the device can be placed approximately 100 mm upstream the catalyst bed.

Figure 1:
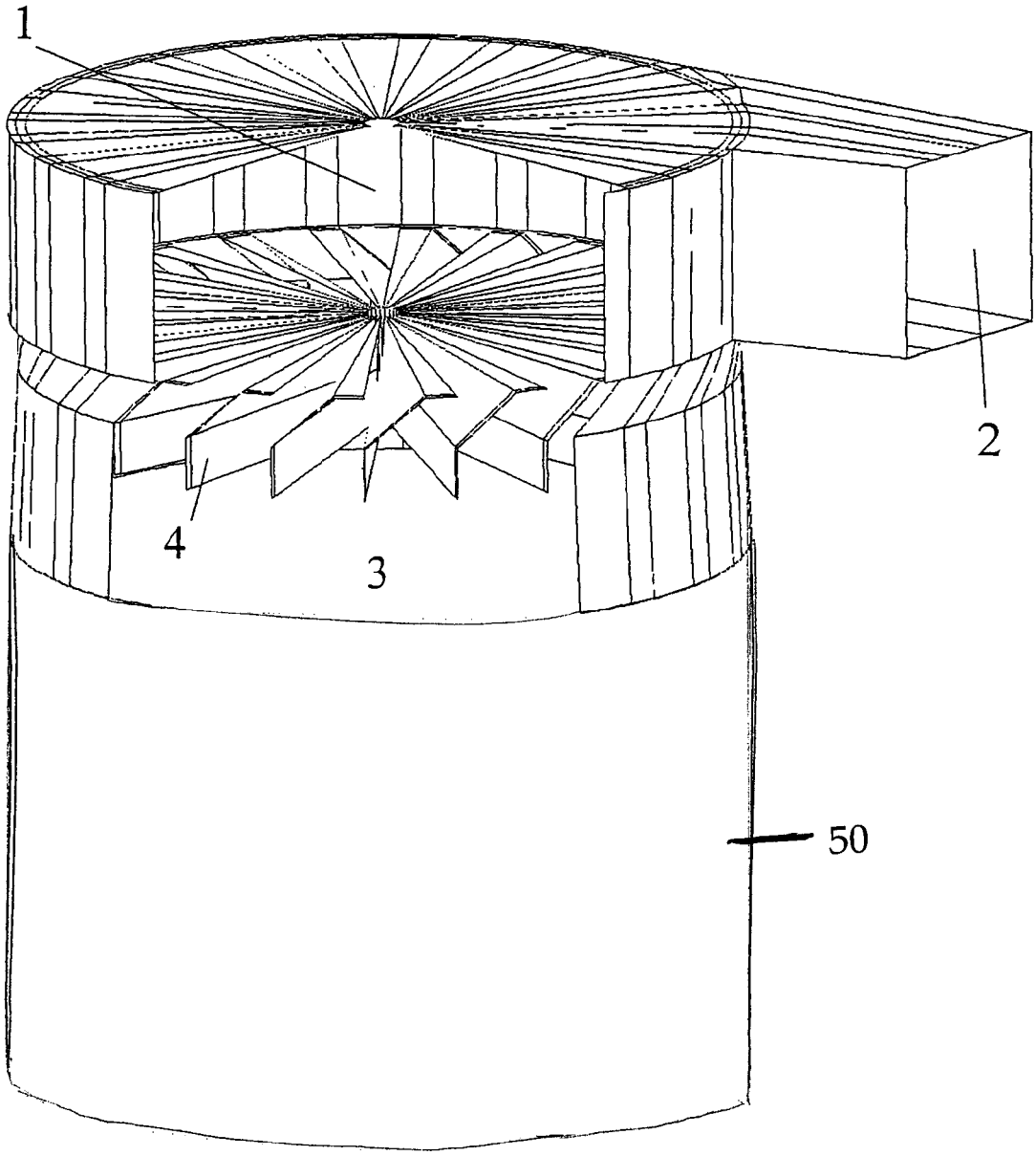
FIG. 1 shows a schematic diagram of the gas distribution device.

The gas distributing device according to the invention is illustrated in FIG. 1 and it consists of a swirl chamber (1) with inlet (2) and outlet sections (3). The cylindrical inlet section is positioned in such a way that the gas enters the swirl chamber tangentially. The swirl chamber contains a stationary, propeller-like element with a number of equally displaced, bent vanes (4), see FIG. 2.

The surface of the upstream part of the vanes lies in a plane perpendicular to the swirl chamber's axis. The downstream parts of the vanes are parallel to the swirl chamber's axis, and the vanes extend radially outwards.

The gas entering the swirl chamber is initially in contact with the surface of the upstream part of the vanes. It is thereafter distributed through the vanes and then enters the downstream part of the vanes, which is parallel to the swirl chamber's axis. The gas direction is thus diverted 90 degrees.

When the redirected gas is downstream the swirling chamber, it encounters the catalyst in the silencer, such as silencer 50 shown in FIG. 1. The catalyst acts as a flow restrictor and a pressure drop of approximately ⅓inlet pipe velocity heads occurs here.

The relative skewness as applied in this invention is defined as the deviation/(mean value) ratio, where both values are calculated on the axial gas velocity component with the surface area through which the gas is distributed acting as a weight function.

Figure 2:
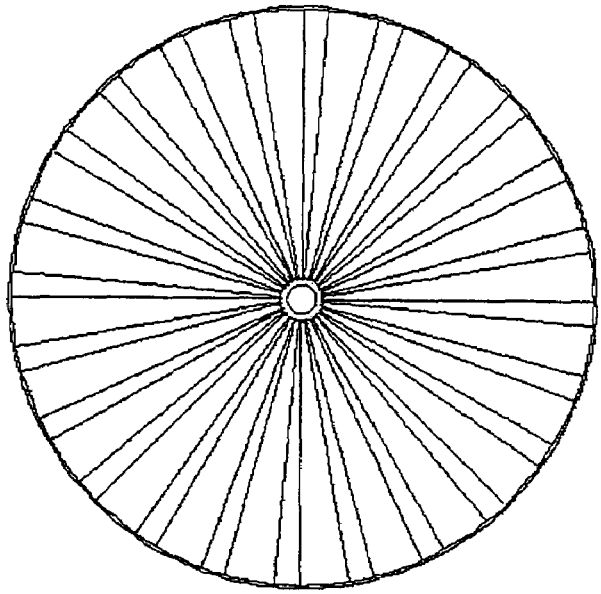
FIG. 2 shows a transverse section through the plates of the gas distributing device.
Figure 3:
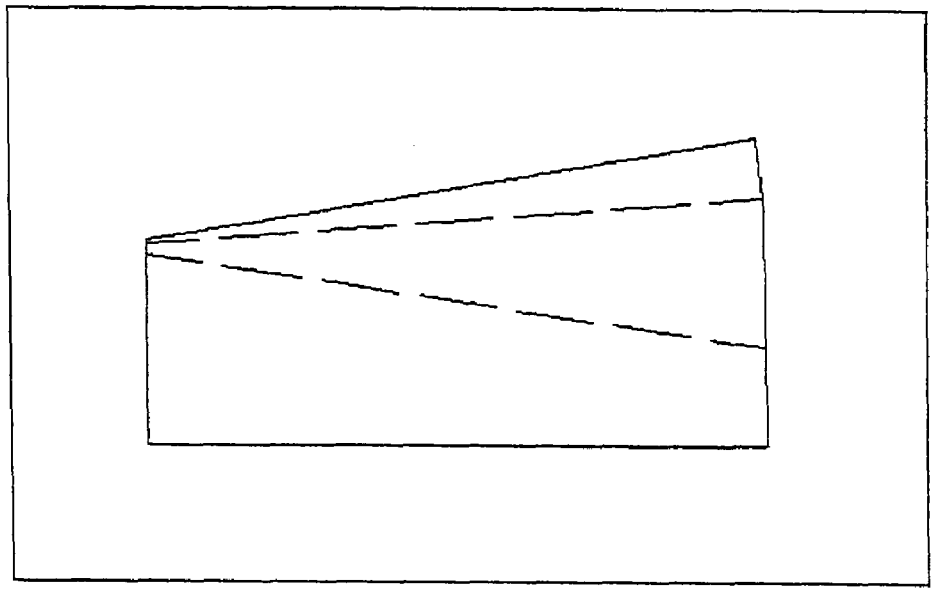
FIG. 3 shows a schematic diagram of a typical vane from the swirl chamber.

Each vane in the swirl chamber is built up of a plate bent in at least two positions. The plate can be bent at angles of, for instance, 40 and 50 degrees respectively, see FIG. 3. The plates are attached to an axis at one end and they extend radially outwards as shown in FIG. 2.

The plates can also be bent at other angles, and they can also have more than two bends. An embodiment of the invention is a device with a vane with several bends, such that the plate has a curved surface between the upstream and the downstream surfaces.

The following examples illustrate the method and device of the invention.

The pressure as given in the examples is measured in velocity head units, which is the dynamic pressure of the gas in the inlet of the different sections.

EXAMPLE

The outlet section of the gas distributor device according to the invention is placed 100 mm from the catalyst in a catalyst-silencer unit of an internal combustion engine. The pressure drop after passage through the gas distributor device and before and after passage through the catalyst bed were measured.

Pressure drop after passage through the gas distributor of the invention and at the surface of the catalyst bed: 0.8 velocity heads Pressure drop in the catalyst bed: 0.35 velocity heads Skewness at the inlet to the catalyst bed: <10%

A skewness value of less than 10% indicates that the gas is well distributed across the surface of the catalyst bed.

COMPARATIVE EXAMPLE

A similar experiment was conducted using a conventional gas distributor with a tangential inlet. The results in this case were:

Pressure drop after passage through the conventional distributor and at the surface of the catalyst: 2.64 velocity heads Pressure drop in the catalyst: 0.34 velocity heads Skewness at the inlet to the catalyst bed: >50%

After catalytic reaction of the exhaust gas, it was observed that a lower conversion in the catalyst was obtained. This was due to the poorer gas flow distribution on entering the catalyst bed.

The invention claimed is:

1. A method for the distribution of gas comprising:

transferring the gas into a swirl chamber through an inlet section positioned tangentially to the swirl chamber;

stopping the swirling motion of the gas in the swirl chamber by passage through a number of equally displaced bent vanes resulting in a homogenous gas flow, the surface of the upstream part of the vanes lying in a plane perpendicular to a longitudinal axis of the swirl chamber, the downstream part of the vanes being parallel to the longitudinal axis of the swirl chamber, and the vanes extending radially outwards and having a common point with the longitudinal axis of the swirl chamber; and passing the gas through an outlet section positioned downstream the swirl chamber, the outlet section having an axis which is parallel to the longitudinal axis of the swirl chamber.

2. A gas distributing device for use in the gas distribution method of claim 1, comprising:

a swirl chamber with an inlet and an outlet section, wherein the inlet section is positioned tangentially to the swirl chamber, and the outlet section is positioned downstream the swirl chamber, the outlet section having an axis which is parallel to a longitudinal axis of the swirl chamber, the swirl chamber containing an element consisting of a number of equally displaced, bent vanes, the surface of the upstream part of the vanes lying in a plane perpendicular to the longitudinal axis of the swirl chamber, the downstream part of the vanes being parallel to the longitudinal axis of the swirl chamber, the vanes extending radially outwards.

3. The gas distributing device according to claim 2 wherein a length of the device in the longitudinal axis of the device is less than about 2.5 times a diameter of the inlet section.

4. The gas distributing device according to claim 2 wherein each of the vanes has a first bent portion which is bent at an angle of about 40 degrees, and a second bent portion which is bent at an angle of about 50 degrees.

5. The gas distributing device according to claim 2 wherein the vanes are bent to form a curvature in the section between the surface of the upstream part of the vanes and the downstream part of the vanes.

6. A silencer-catalyst system for an internal combustion engine comprising the gas distributing device according to claim 2.

7. A method for the distribution of gas comprising:

transferring the gas into a swirl chamber through an inlet section positioned tangentially to the swirl chamber so that the inlet axis of the inlet section is perpendicular to a longitudinal axis of the swirl chamber;

stopping the swirling motion of the gas in the swirl chamber by passage through a number of equally displaced bent vanes resulting in a homogenous gas flow, the surface of the upstream part of the vanes lying in a plane perpendicular to the longitudinal axis of the swirl chamber, the downstream part of the vanes being parallel to the longitudinal axis of the swirl chamber, and the vanes extending radially outwards; and passing the gas through an outlet section positioned downstream the swirl chamber, the outlet section having an axis which is parallel to the longitudinal axis of the swirl chamber.

* * * * *